US011784397B1

(12) United States Patent
Lee et al.

(10) Patent No.: US 11,784,397 B1
(45) Date of Patent: Oct. 10, 2023

(54) WEARABLE DEVICE

(71) Applicant: Quanta Computer Inc., Taoyuan (TW)

(72) Inventors: Kuan-Hsien Lee, Taoyuan (TW); Chung-Ting Hung, Taoyuan (TW); Chin-Lung Tsai, Taoyuan (TW); Yu-Chen Zhao, Taoyuan (TW); Kai-Hsiang Chang, Taoyuan (TW); Chun-I Cheng, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 0 days.

(21) Appl. No.: 17/814,307

(22) Filed: Jul. 22, 2022

(30) Foreign Application Priority Data

Jun. 14, 2022 (TW) ..... 111121983

(51) Int. Cl.
*H01Q 1/27* (2006.01)
*H01Q 5/385* (2015.01)
*H01Q 9/42* (2006.01)

(52) U.S. Cl.
CPC ..... *H01Q 1/273* (2013.01); *H01Q 5/385* (2015.01); *H01Q 9/42* (2013.01)

(58) Field of Classification Search
CPC ..... H01Q 5/378; H01Q 5/392; H01Q 5/385
See application file for complete search history.

(56) References Cited

U.S. PATENT DOCUMENTS 10,454,156 B1 * 10/2019 Yang ..... H01Q 1/48
2018/0062243 A1 * 3/2018 Yang ..... H01Q 1/2291
2022/0336948 A1 * 10/2022 Chang ..... H01Q 9/42

FOREIGN PATENT DOCUMENTS

TW 201324942 A 6/2013

OTHER PUBLICATIONS

Chinese language office action dated Jun. 16, 2023, issued in application No. TW 111121983.

* cited by examiner

*Primary Examiner* — Daniel Munoz
(74) *Attorney, Agent, or Firm* — McClure, Qualey & Rodack, LLP

(57) ABSTRACT

A wearable device includes a first radiation element, a second radiation element, a third radiation element, and a dielectric substrate. The first radiation element has a feeding point. The second radiation element is coupled to a ground voltage, and is disposed adjacent to the first radiation element. The third radiation element is coupled to the ground voltage, and is disposed adjacent to the first radiation element. The third radiation element is at least partially surrounded by the first radiation element. The first radiation element, the second radiation element, and the third radiation element are disposed on the dielectric substrate. An antenna structure is formed by the first radiation element, the second radiation element, and the third radiation element.

8 Claims, 3 Drawing Sheets

300

WEARABLE DEVICE

CROSS REFERENCE TO RELATED APPLICATIONS

This application claims priority of Taiwan Patent Application No. 111121983 filed on Jun. 14, 2022, the entirety of which is incorporated by reference herein.

BACKGROUND OF THE INVENTION

Field of the Invention

The disclosure generally relates to a wearable device, and more particularly, to a wearable device and an antenna structure therein.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi systems and using frequency bands of 2.4 GHz, 5.2 GHz, and 5.8 GHz.

Antennas are indispensable elements for wireless communication. If an antenna for signal reception and transmission has insufficient operational bandwidth, it may degrade the communication quality of the relative mobile device. Accordingly, it has become a critical challenge for antenna designers to design a small-size, wideband antenna structure.

BRIEF SUMMARY OF THE INVENTION

In an exemplary embodiment, the invention is directed to a wearable device that includes a first radiation element, a second radiation element, a third radiation element, and a dielectric substrate. The first radiation element has a feeding point. The second radiation element is coupled to a ground voltage, and is disposed adjacent to the first radiation element. The third radiation element is coupled to the ground voltage, and is disposed adjacent to the first radiation element. The third radiation element is at least partially surrounded by the first radiation element. The first radiation element, the second radiation element, and the third radiation element are disposed on the dielectric substrate. An antenna structure is formed by the first radiation element, the second radiation element, and the third radiation element.

In some embodiments, the antenna structure covers a first frequency band, a second frequency band, and a third frequency band. The first frequency band is from 2400 MHz to 2500 MHz. The second frequency band is from 5150 MHz to 5850 MHz. The third frequency band is from 5925 MHz to 7125 MHz.

In some embodiments, the first radiation element substantially has a meandering shape that defines a notch region. The third radiation element is at least partially disposed in the notch region.

In some embodiments, the second radiation element substantially has a variable-width straight-line shape.

In some embodiments, the second radiation element includes a first branch and a second branch which substantially extend in opposite directions.

In some embodiments, the first branch of the second radiation element further includes a terminal widening portion.

In some embodiments, the third radiation element substantially has an inverted T-shape.

In some embodiments, the third radiation element includes a third branch and a fourth branch which substantially extend in opposite directions.

In some embodiments, the length of the first radiation element is substantially equal to 0.25 wavelength of the first frequency band. The length of the first branch of the second radiation element is substantially equal to 0.25 wavelength of the second frequency band. The length of the third branch of the third radiation element is substantially equal to 0.25 wavelength of the third frequency band.

In some embodiments, a first coupling gap is formed between the first radiation element and the second radiation element. A second coupling gap and a third coupling gap are formed between the first radiation element and the third radiation element. The width of each of the first coupling gap, the second coupling gap, and the third coupling gap is from 0.1 mm to 1 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
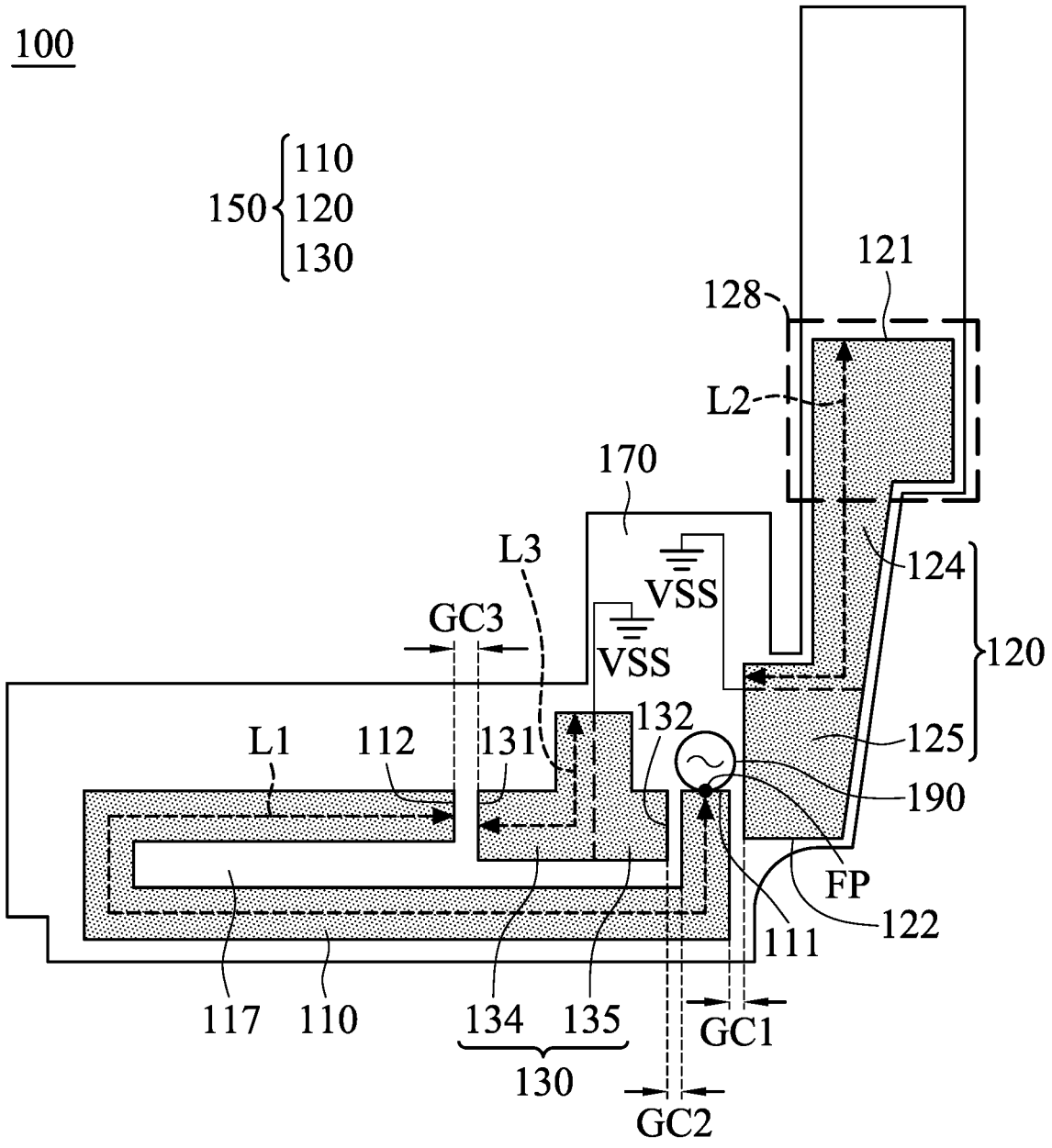
FIG. 1 is a diagram of a wearable device according to an embodiment of the invention.

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a diagram of a wearable device 100 according to an embodiment of the invention. For example, the wearable device 100 may be an HMD (Head Mounted Display), smart glasses, or a smart watch, but it is not limited thereto. In some embodiments, the wearable device 100 may be applied in the fields of VR (Virtual Reality), MR (Mixed Reality), or AR (Augmented Reality).

As shown in FIG. 1, the wearable device 100 at least includes a first radiation element 110, a second radiation element 120, a third radiation element 130, and a dielectric substrate 170. The first radiation element 110, the second radiation element 120, and the third radiation element 130 may all be made of metal materials, such as copper, silver, aluminum, iron, or their alloys. It should be understood that the wearable device 100 may further include other components, such as a processor, a display device, a supply module, and/or a housing, although they are not displayed in FIG. 1.

The first radiation element 110 may substantially have a meandering shape. Specifically, the first radiation element 110 has a first end 111 and a second end 112. A feeding point FP is positioned at the first end 111 of the first radiation element 110. The second end 112 of the first radiation element 110 is an open end. The feeding point FP may be further coupled to a signal source 190. For example, the signal source 190 may be an RF (Radio Frequency) module. In some embodiments, the first radiation element 110 can define a notch region 117, which may substantially have a straight-line shape, a rectangular shape, or an L-shape, but it is not limited thereto.

The second radiation element 120 may substantially have a variable-width straight-line shape, and it may be adjacent to the first radiation element 110. It should be noted that the term "adjacent" or "close" over the disclosure means that the distance (spacing) between two corresponding elements is smaller than a predetermined distance (e.g., 5 mm or the shorter), but often does not mean that the two corresponding elements directly touch each other (i.e., the aforementioned distance/spacing between them is reduced to 0). Specifically, the second radiation element 120 includes a first branch 124 and a second branch 125. Both of the first branch 124 and the second branch 125 are coupled to a ground voltage VSS. For example, the ground voltage VSS may be provided by a system ground plane (not shown). The first branch 124 has a first open end 121. The second branch 125 has a second open end 122. The first open end 121 of the first branch 124 and the second open end 122 of the second branch 125 may substantially extend in opposite directions and away from each other. In some embodiments, the first branch 124 of the second radiation element 120 further includes a terminal widening portion 128, which may substantially have a rectangular shape or a square shape. In some embodiments, a first coupling gap GC1 is formed between the first end 111 of the first radiation element 110 and the second branch 125 of the second radiation element 120, such that the second radiation element 120 is excited by the first radiation element 110 using a coupling mechanism.

The third radiation element 130 may substantially have an inverted T-shape, and it may be adjacent to the first radiation element 110. The third radiation element 130 is at least partially surrounded by the first radiation element 110. For example, the third radiation element 130 may be at least partially disposed in the notch region 117 of the first radiation element 110. Specifically, the third radiation element 130 includes a third branch 134 and a fourth branch 135. Both of the third branch 134 and the fourth branch 135 are coupled to the ground voltage VSS. The third branch 134 has a first open end 131. The fourth branch 135 has a second open end 132. The first open end 131 of the third branch 134 and the second open end 132 of the fourth branch 135 may substantially extend in opposite directions and away from each other. In some embodiments, a second coupling gap GC2 is formed between the second end 112 of the first radiation element 110 and the first open end 131 of the third branch 134, and a third coupling gap GC3 is formed between the first end 111 of the first radiation element 110 and the second open end 132 of the fourth branch 135, such that the third radiation element 130 is excited by the first radiation element 110 using a coupling mechanism.

The dielectric substrate 170 may be an FR4 (Flame Retardant 4) substrate, a PCB (Printed Circuit Board), or an FPC (Flexible Printed Circuit). The first radiation element 110, the second radiation element 120, and the third radiation element 130 may be disposed on the same surface of the dielectric substrate 170.

In a preferred embodiment, an antenna structure 150 of the wearable device 100 is formed by the first radiation element 110, the second radiation element 120, and the third radiation element 130. For example, the antenna structure 150 may be a planar antenna structure. However, the invention is not limited thereto. In alternative embodiments, adjustments are made such that the antenna structure 150 is a 3D (Three Dimensional) antenna structure, without affecting its operational performance.

Figure 2:
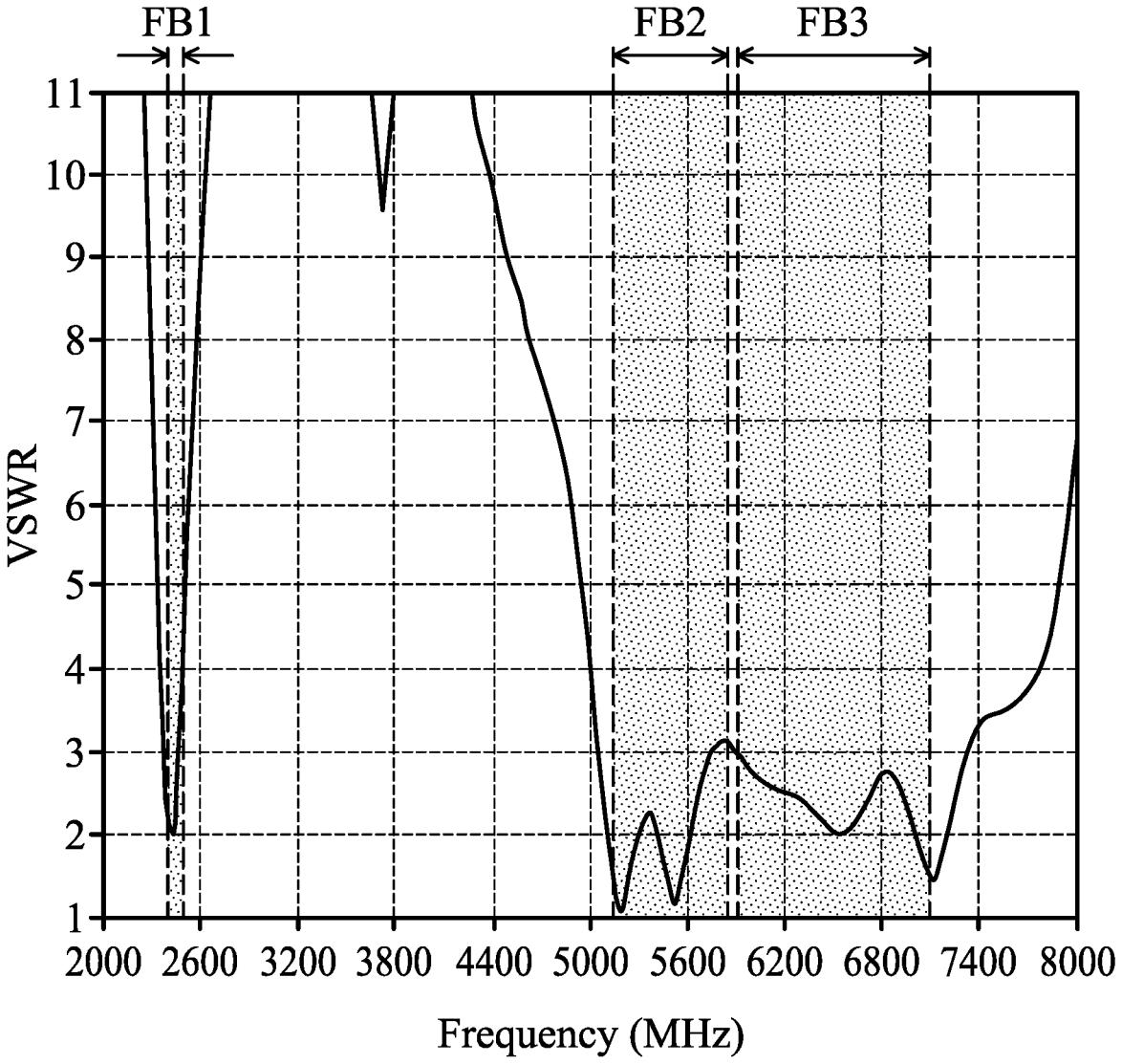
FIG. 2 is a diagram of VSWR (Voltage Standing Wave Ratio) of an antenna structure of a wearable device according to an embodiment of the invention.

FIG. 2 is a diagram of VSWR (Voltage Standing Wave Ratio) of the antenna structure 150 of the wearable device 100 according to an embodiment of the invention. The horizontal axis represents the operational frequency (MHz), and the vertical axis represents the VSWR. According to the measurement of FIG. 2, the antenna structure 150 can cover a first frequency band FB1, a second frequency band FB2, and a third frequency band FB3. For example, the first frequency band FB1 may be from 2400 MHz to 2500 MHz, the second frequency band FB2 may be from 5150 MHz to 5850 MHz, and the third frequency band FB3 may be from 5925 MHz to 7125 MHz. Therefore, the antenna structure 150 of the wearable device 100 can support at least the wideband operations of conventional WLAN (Wireless Local Area Network) and next-generation Wi-Fi 6E.

In some embodiments, the operational principles of the antenna structure 150 of the wearable device 100 will be described as follows. The first radiation element 110 is excited to generate the first frequency band FB1. In the second radiation element 120, the first branch 124 is excited to generate the second frequency band FB2, and the second branch 125 is configured to fine-tune the impedance matching of the second frequency band FB2. In addition, the terminal widening portion 128 of the first branch 124 of the second radiation element 120 is configured to increase the operational bandwidth of the second frequency band FB2. In the third radiation element 130, the third branch 134 is excited to generate the third frequency band FB3, and the fourth branch 135 is configured to fine-tune the impedance matching of the third frequency band FB3.

In some embodiments, the element sizes of the wearable device 100 will be described as follows. The length L1 of the first radiation element 110 may be substantially equal to 0.25 wavelength (λ/4) of the first frequency band FB1 of the antenna structure 150. The length L2 of the first branch 124 of the second radiation element 120 may be substantially equal to 0.25 wavelength (λ/4) of the second frequency band FB2 of the antenna structure 150. The length L3 of the third branch 134 of the third radiation element 130 may be substantially equal to 0.25 wavelength (λ/4) of the third frequency band FB3 of the antenna structure 150. The width of the first coupling gap GC1 may be from 0.1 mm to lmm. The width of the second coupling gap GC2 may be from 0.1 mm to lmm. The width of the third coupling gap GC3 may be from 0.1 mm to 1 mm. The above ranges of element sizes and parameters are calculated and obtained according to many experiment results, and they help to optimize the operational bandwidth and impedance matching of the antenna structure 150 of the wearable device 100.

Figure 3:
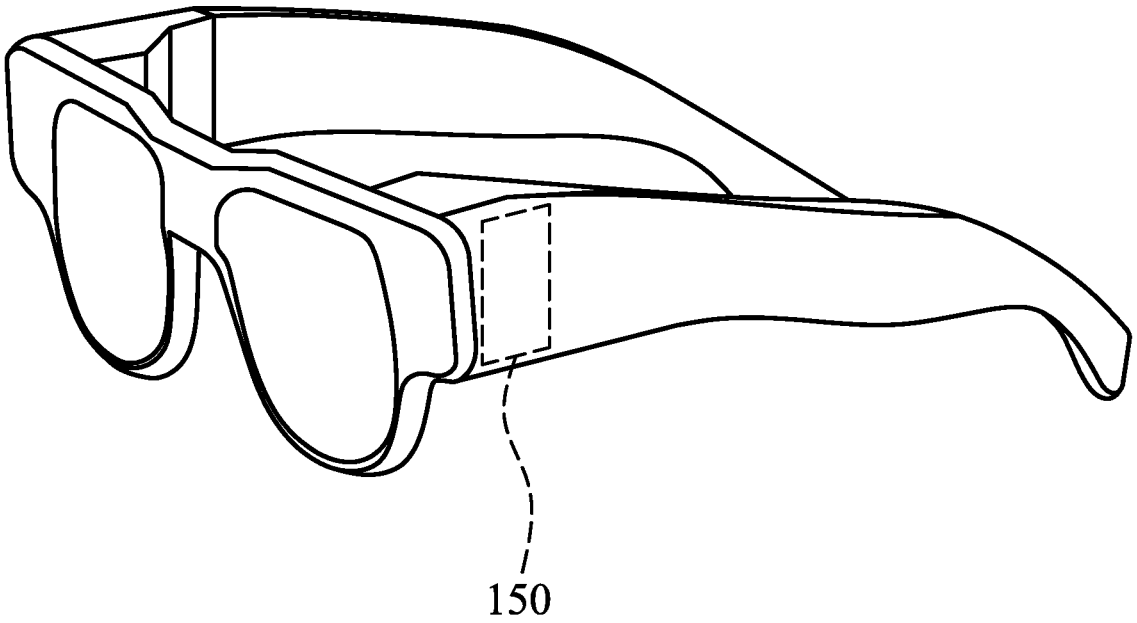
FIG. 3 is a perspective view of an HMD (Head Mounted Display) according to an embodiment of the invention.

FIG. 3 is a perspective view of an HMD 300 according to an embodiment of the invention. In the embodiment of FIG. 3, the HMD 300 is implemented with smart glasses, and the aforementioned antenna structure 150 is positioned at one side of the smart glasses. In addition, a metal frame of the smart glasses can be used as a system ground plane. Other features of the wearable device 300 of FIG. 3 are similar to those of the wearable device 100 of FIG. 1. Accordingly, the two embodiments can achieve similar levels of performance.

The invention proposes a novel wearable device and a novel antenna structure therein. In comparison to the conventional design, the invention has at least the advantages of small size, wide bandwidth, and low manufacturing cost. Therefore, the invention is suitable for application in a variety of fields of VR, MR and AR.

Note that the above element sizes, element shapes, and frequency ranges are not limitations of the invention. An antenna designer can fine-tune these settings or values according to different requirements. It should be understood that the wearable device of the invention is not limited to the configurations of FIGS. 1-3. The invention may merely include any one or more features of any one or more embodiments of FIGS. 1-3. In other words, not all of the features displayed in the figures should be implemented in the wearable of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A wearable device, comprising:

a first radiation element, having a feeding point;

a second radiation element, coupled to a ground voltage, and disposed adjacent to the first radiation element;

a third radiation element, coupled to the ground voltage, and disposed adjacent to the first radiation element, wherein the third radiation element is at least partially surrounded by the first radiation element; and a dielectric substrate, wherein the first radiation element, the second radiation element, and the third radiation element are disposed on a same surface of the dielectric substrate;

wherein an antenna structure is formed by the first radiation element, the second radiation element, and the third radiation element;

wherein the second radiation element comprises a first branch and a second branch extending in opposite directions;

wherein the first branch of the second radiation element further comprises a terminal widening portion.

2. The wearable device as claimed in claim 1, wherein the antenna structure covers a first frequency band, a second frequency band, and a third frequency band, the first frequency band is from 2400 MHz to 2500 MHz, the second frequency band is from 5150 MHz to 5850 MHz, and the third frequency band is from 5925 MHz to 7125 MHz.

3. The wearable device as claimed in claim 1, wherein the first radiation element substantially has a meandering shape that defines a notch region, and the third radiation element is at least partially disposed in the notch region.

4. The wearable device as claimed in claim 1, wherein the second radiation element substantially has a variable-width straight-line shape.

5. The wearable device as claimed in claim 1, wherein the third radiation element substantially has an inverted T-shape.

6. The wearable device as claimed in claim 2, wherein the third radiation element comprises a third branch and a fourth branch extending in opposite directions.

7. The wearable device as claimed in claim 6, wherein a length of the first radiation element is substantially equal to 0.25 wavelength of the first frequency band, wherein a length of the first branch of the second radiation element is substantially equal to 0.25 wavelength of the second frequency band, and wherein a length of the third branch of the third radiation element is substantially equal to 0.25 wavelength of the third frequency band.

8. The wearable device as claimed in claim 1, wherein a first coupling gap is formed between the first radiation element and the second radiation element, wherein a second coupling gap and a third coupling gap are formed between the first radiation element and the third radiation element, and wherein a width of each of the first coupling gap, the second coupling gap, and the third coupling gap is from 0.1 mm to 1 mm.

* * * * *